US008056385B2

(12) United States Patent
Okuzumi et al.

(10) Patent No.: US 8,056,385 B2
(45) Date of Patent: Nov. 15, 2011

(54) PRESS FORMING DIE ASSEMBLY

(75) Inventors: Shiyouhei Okuzumi, Tochigi (JP); Takeshi Sakurai, Tochigi (JP); Shinichi Murakami, Tochigi (JP); Tomio Hasegawa, Tochigi (JP); Takashi Sera, Tochigi (JP)

(73) Assignee: Honda Motor Co., Ltd., Tokyo (JP)

( * ) Notice: Subject to any disclaimer, the term of this patent is extended or adjusted under 35 U.S.C. 154(b) by 654 days.

(21) Appl. No.: 12/194,857

(22) Filed: Aug. 20, 2008

(65) Prior Publication Data

US 2009/0049886 A1 Feb. 26, 2009

(30) Foreign Application Priority Data

Aug. 21, 2007 (JP) ..... 2007-214738

(51) Int. Cl.
*B21D 22/00* (2006.01)

(52) U.S. Cl. ..... 72/350

(58) Field of Classification Search ..... 72/347, 72/350, 351, 60, 348, 360; 428/573, 574, 428/600, 602
See application file for complete search history.

(56) References Cited

U.S. PATENT DOCUMENTS

| | | | | |
|---|---|---|---|---|
| 1,881,517 | A * | 10/1932 | Groehn | 72/350 |
| 4,195,510 | A * | 4/1980 | Juergens | 72/350 |
| 5,901,599 | A * | 5/1999 | Sato et al. | 72/350 |
| 5,941,110 | A * | 8/1999 | Cao et al. | 72/21.4 |
| 6,354,131 | B1 * | 3/2002 | Pirchl | 72/351 |
| 6,745,609 | B2 * | 6/2004 | Garnett et al. | 72/350 |
| 7,320,239 | B1 * | 1/2008 | Kruger et al. | 72/350 |
| 7,340,934 | B2 * | 3/2008 | Kurokawa et al. | 72/350 |

FOREIGN PATENT DOCUMENTS

| | | |
|---|---|---|
| JP | 1-299717 | * 12/1989 |
| JP | 06-000542 | 1/1994 |
| JP | 2001-259751 | 9/2001 |
| JP | 2002-263746 | * 9/2002 |

* cited by examiner

*Primary Examiner* — Edward Tolan
(74) *Attorney, Agent, or Firm* — Rankin, Hill & Clark LLP

(57) ABSTRACT

A press forming die assembly for press forming a blank material includes a draw forming portion that the blank material flows and a draw bead for controlling the amount of the blank material flowing into the draw forming portion. A first draw bead is provided at a periphery of the draw forming portion in a direction substantially parallel to an outer peripheral shape of the draw forming portion. A second draw bead extends from the first draw bead toward the outside of the draw forming portion in a direction intersecting the first draw bead. The blank material includes a thick sheet portion having a greater thickness than the other portion or a high rigidity portion having a higher rigidity than that of the other portion. The second draw bead is provided at a portion corresponding to the thick sheet portion or the high rigidity portion of the blank material.

5 Claims, 5 Drawing Sheets

PRESS FORMING DIE ASSEMBLY

BACKGROUND OF THE INVENTION

1. Technical Field

The present invention relates to a press forming die assembly including a draw bead for controlling the amount of a blank material that flows into a draw-forming portion in press forming. Specifically, the present invention relates to improvements in the shape of a draw bead used in press forming of a composite blank material that includes sheet materials having different sheet thicknesses and rigidities.

2. Background Art

Panels, such as door panels for vehicles, are produced by press forming a composite blank material including plural sheet materials that have different sheet thicknesses and rigidities and are integrally connected by butt-welding.

A die assembly used in press forming includes a draw forming portion that has a draw forming concave portion, a draw forming convex portion, and a forming surface corresponding to a product surface of a panel. The concave portion is provided at the center of a die, and the convex portion is provided at an end portion of a punch. In the press forming die assembly, a composite blank material is held by a peripheral portion of the die and a blank holder, and the convex portion of the punch is moved to the concave portion of the die. As a result, the composite blank material flows into the draw forming portion, whereby a panel having a convex product surface, for example, is formed. In this case, a draw bead is provided on the holding surfaces of the peripheral portion of the die and the blank holder in a direction approximately parallel to the outer peripheral shape of the draw forming portion. The flow amount of the composite blank material is controlled by the draw bead in press forming.

When a blank material having a thin sheet portion and a thick sheet portion is used as a composite blank material, a step portion is provided to an upper die of a press forming die assembly. The step portion corresponds to the difference of the sheet thickness between the thin sheet portion and the thick sheet potion. The step portion is welded with a material that is harder than the base material of the die, and a sharp edge is formed thereon by a finish processing. In press forming, since there is a difference of inflow shear amount due to the difference in sheet thicknesses at the connected portion of the thin sheet portion and the thick sheet portion, the thick sheet portion may overlap with the thin sheet portion. Such overlap is prevented by the above step portion.

In the case of using the step portion, forming failure such as buckling wrinkling easily occurs due to the difference in sheet thicknesses of the thick sheet portion and the thin sheet portion. Accordingly, adjustment operation for a die assembly requires time in trial forming, and forming failure may be unavoidable in a product having a complicated shape.

Moreover, the following problems may occur in commercial production. FIGS. 7A and 7B show an example of a composite blank material 210 having a panel 220 that is formed by a conventional press forming die assembly. FIG. 7A shows a top view, and FIG. 7B shows a cross sectional drawing taken along line 7B-7B. As shown in FIG. 7A, when the composite blank material 210 moves to a draw forming portion, rotation R of the material of a thick sheet portion 211 (movement of a connecting line 213 of the thick sheet portion 211 and the thin sheet portion 212 toward the thin sheet portion 212) occurs. Then, a crack H is generated at the connecting line 213. In this case, a sharp edge of the thick sheet portion 211 passes through the die assembly, whereby there is wear of the die assembly, and particles are generated and may be trapped at a product surface 221 of the panel 220.

As shown in FIGS. 7A and 7B, buckling wrinkling I is generated at the thin sheet portion 212 by the rotation R of the material of the thick sheet portion 211. When the composite blank material 210 is used for an inner panel of a vehicle door, an end surface of an outer panel is connected to an inner panel by a hemming process. In this case, the end surface of the outer panel may be degraded by the buckling wrinkling of the inner panel (for example, rough portions may be produced or adhesion failure may occur at the end surface of the outer panel).

Moreover, because of the rotation R of the material of the thick sheet portion 211, strain is concentrated in the thin sheet portion 212, and the flow of the material into the draw forming portion is decreased. Therefore, as shown in FIG. 7A, a crack J may be generated at a ridge line portion 222 in a raised wall of the product surface 221. FIG. 7A shows a reference numeral 214, which indicates a bead portion formed by a draw bead of a press forming die assembly, and a reference numeral 223, which indicates a flange portion of the thick sheet portion 211. In addition, FIG. 7A shows a reference numeral F, which indicates a flow direction of a material in draw forming.

As described above, in the conventional press forming die assembly, forming failure may occur in the vicinity of the connected portion of the thick sheet portion and the thin sheet portion. Accordingly, adjustment operation of a die assembly is time consuming in trial forming, and the quality of products may be degraded in commercial production.

In order to solve the above problems, several techniques have been disclosed to improve the shape of the above draw bead for controlling the flow amount of a material. For example, Japanese Unexamined Patent Application Publication No. 2001-259751 discloses a technique for generating a large flow resistance. In this technique, a draw bead is formed in a trapezoidal shape. In a boundary area including a connected portion of a thin sheet portion and a thick sheet portion of a composite blank material, the height, the width, and the curvature radius of corners of the trapezoidal shape are greater than those in an area other than the boundary area. However, in this technique, the material of the thick sheet portion may be rotated by movement of the composite blank material to a draw forming portion. Moreover, according to the increase in the flowing resistance, the sheet thickness of a ridge line portion in a raised wall on a product surface of a panel is decreased. Therefore, the above problems cannot be solved. Specifically, when a corner of a draw forming portion is close to the connected portion of the thick sheet portion and the thin sheet portion, the above problems become serious. The above problems occur in press forming of a composite blank material, which has different rigidities, including a portion with high rigidity and a portion with low rigidity.

SUMMARY OF THE INVENTION

An object of the present invention is to provide a press forming die assembly in which forming failure is prevented from occurring in the vicinity of a connected portion of a thick sheet portion (or a high rigidity portion) and a thin sheet portion (or a low rigidity portion). Moreover, according to the press forming die assembly, adjustment of the die assembly requires less time, and the quality of products can be improved in commercial production.

The inventors have focused on the shape of a draw bead for controlling the amount of a blank material that flows into a draw forming portion of a press forming die assembly. The inventors have conducted intensive research on the origins of forming failure in the vicinity of a connected portion of a thick sheet portion and a thin sheet portion, and the following facts were determined. In order to prevent rotation of a material of a thick sheet portion (movement of a connecting line of a thick sheet portion and a thin sheet portion toward the thin sheet portion), an inflow shear at the thin sheet portion was experimentally reduced. In this case, in addition to a conventional draw bead which ran in a direction approximately parallel to the outer peripheral shape of a draw forming portion, another draw bead was formed at the thin sheet portion of the outer periphery of the draw forming portion. The additional draw bead ran in a direction approximately parallel to the conventional draw bead. However, a large amount of forming failure occurred compared to the case in which only a conventional bead was used.

Thus, the inventors found that the rotation of the thick sheet portion may not be caused by the inflow shear at the thin sheet portion, but may instead be caused by a shrink flange forming. As shown in FIG. 7A, the shrink flange forming occurs at a flange portion 223 of the thick sheet portion 211 according to the shape of a corner of a draw forming portion of a press forming die assembly. In this case, FIG. 7A shows an arrow P indicating an elongation direction of a material, an arrow Q indicating a shrinkage direction of the material, and a reference numeral K indicating strain (wrinkling).

In view of the above finding, the inventors have found that the forming failure can be prevented by providing another draw bead at a thick sheet portion in a direction intersecting a conventional draw bead. The additional draw bead is provided so that strain occurring at the thick sheet portion in a shrink flange forming is not transmitted to a thin sheet portion (so that the rigidity of the thin sheet portion is sufficiently increased). In this case, the additional draw bead must be extended from the conventional draw bead toward the outside of a draw forming portion. This is because when there is a clearance between the conventional draw bead and the additional draw bead, a blank material is prevented from flowing to the draw forming portion by the clearance. As a result, the sheet thickness of a ridge line portion in a raised wall of a product surface may be decreased. The above findings are described with reference to a blank material made of sheet materials having different sheet thicknesses. In a blank material made of sheet materials having different rigidities, the portion with higher rigidity corresponds to the thick sheet portion, and the portion with lower rigidity corresponds to the thin sheet portion. Therefore, the above findings can be used for a blank material made of sheet materials having different rigidities.

The present invention has been completed in view of the above. That is, the present invention provides a die assembly for press forming a blank material. The die assembly includes a draw forming portion into which the blank material flows in press forming, and includes a draw bead for controlling the amount of the blank material flowing into the draw forming portion. The draw bead includes a first draw bead and a second draw bead. The first draw bead is provided at the periphery of the draw forming portion in a direction approximately parallel to the outer peripheral shape of the draw forming portion. The second draw bead extends from the first draw bead toward the outside of the draw forming portion in a direction intersecting the first draw bead. The blank material includes a thick sheet portion having a larger thickness than that of the other portion, or includes a high rigidity portion having a higher rigidity than that of the other portion. The second draw bead is provided to the die assembly at a portion corresponding to the thick sheet portion or the high rigidity portion of the blank material. Hereinafter, in order to simplify the description, the high rigidity portion (and a low rigidity portion) will be represented by the thick sheet portion (and a thin sheet portion).

In the press forming die assembly of the present invention, the second draw bead extends from the first draw bead toward the outside of the draw forming portion in the direction intersecting the first draw bead (that is, in a direction approximately parallel to the flowing direction of the blank material to the draw forming portion). The first draw bead may be formed by a conventional technique. In general, in shrink flange forming of a flange portion of a thick sheet portion, strain occurs according to the shape of a corner of a draw forming portion. In contrast, since the second draw bead of the present invention has the above shape, such strain is not transmitted to a thin sheet portion. Therefore, rotation of the thick sheet portion (movement of the connecting line of the thick sheet portion and the thin sheet portion toward the thin sheet portion) can be prevented, whereby the thick sheet portion will not overlap with the thin sheet portion.

Accordingly, buckling wrinkling does not occur on the thin sheet portion. Therefore, when a blank material is used for an inner panel of a vehicle door, an end surface of an outer panel can be connected to an inner panel by a hemming process without deteriorating the quality of the outer panel by buckling wrinkling of the inner panel. Moreover, strain is not concentrated at the thin sheet portion, and a sufficient amount of the material flows into the draw forming portion, whereby a crack does not form at a ridge line portion in a raised wall of a product surface. Furthermore, when a material including a thick sheet portion and a thin sheet portion, which have different sheet thicknesses, is used as a blank material, a die assembly is not passed through by a sharp edge of the thick sheet portion. Therefore, wear of the die assembly can be avoided, and particles due to the wear are not generated, whereby particles are not trapped at the product surface of a panel.

Various structures may be used for the press forming die assembly of the present invention. For example, a step may be provided at a boundary portion between the first draw bead and the second draw bead. In this case, while a blank material moves toward the inside of the draw forming portion, when the blank material passes through the second draw bead, the cross section thereof is formed into a shape corresponding to the shape of the second draw bead (convex shape or concave shape). After the blank material passes through the second draw bead, the blank material passes through the step at the boundary portion between the first draw bead and the second draw bead and passes through the first draw bead, whereby the blank material is flattened.

An outer side end portion of the second draw portion may have a depth that is greater than that of the boundary portion between the first draw bead and the second draw bead. In this case, rotation of a thick sheet portion can be prevented by the end portion of the outside of the second draw bead having a depth greater than that of the boundary portion between the first draw bead and the second draw bead.

According to the press forming die assembly of the present invention, the second draw bead can prevent strain from being transmitted to the thin sheet portion, the strain occurring at the thick sheet portion in shrink flange forming. Therefore, the rotation of the thick sheet portion can be prevented, and the thick sheet portion will not overlap the thin sheet portion. Accordingly, forming failure in the vicinity of the connected portion of the thick sheet portion and the thin sheet portion can be prevented. Moreover, the adjustment operation of a die assembly requires less time in trial forming, and the quality of products can be improved in commercial production.

BRIEF DESCRIPTION OF DRAWINGS

FIG. 2A is a sectional side view showing a condition in which a blank material is held by a blank holder, and FIG. 2B is a sectional side view showing a condition in which a punch is pressed to a die until a bottom dead point.

FIG. 3A shows a plan view, FIG. 3B shows a cross section taken along line 3B-3B in FIG. 3A, and FIG. 3C shows a cross section taken along line 3C-3C in FIG. 3A.

FIG. 7A shows a top view, and FIG. 7B shows a cross section taken along line 7B-7B.

EMBODIMENTS OF THE PRESENT INVENTION

(1) Structures of Embodiments

Figure 1:
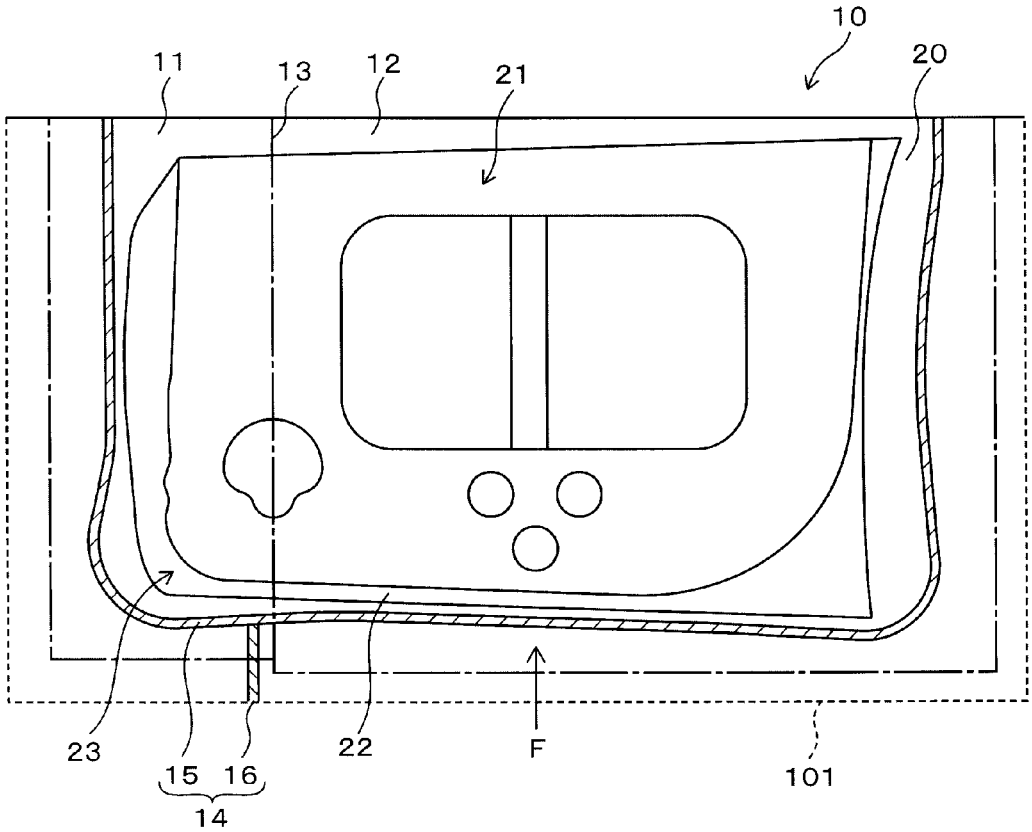
FIG. 1 is a plan view showing a composite blank material that includes a panel formed by a press forming die assembly of an embodiment relating to the present invention.
Figure 2A:
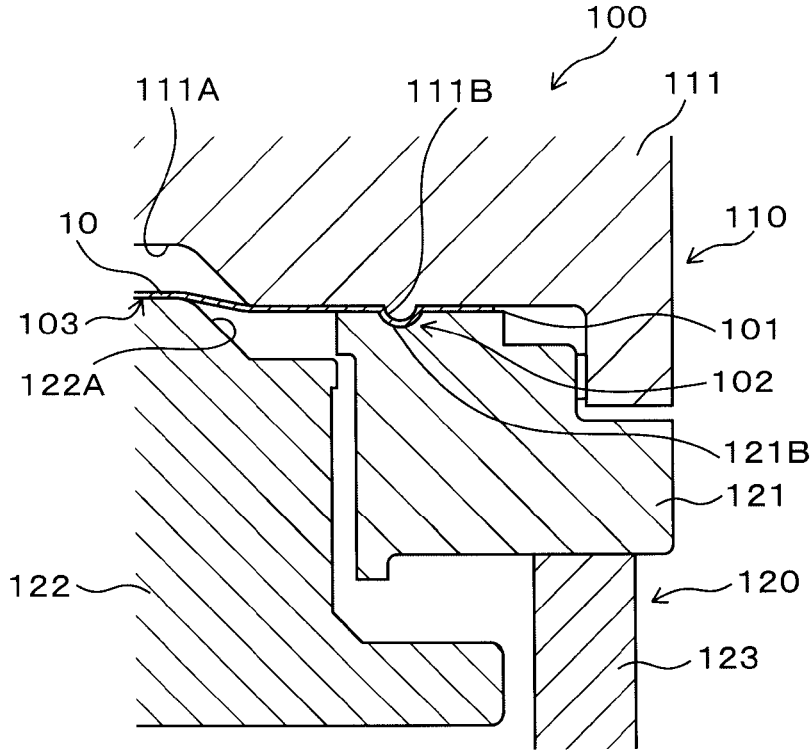
FIGS. 2A and 2B show a structure of a press forming die assembly of an embodiment relating to the present invention.
Figure 2B:
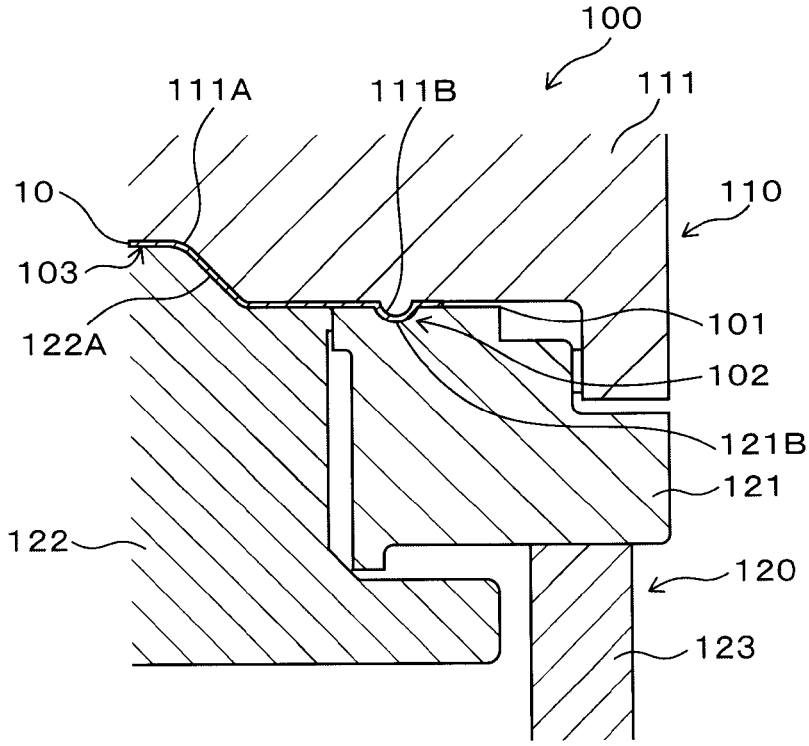

Hereinafter, embodiments of the present invention will be described with reference to the figures. FIG. 1 is a plan view showing a composite blank material 10 that includes a panel 20 formed by a press forming die assembly 100 of an embodiment relating to the present invention. In FIG. 1, reference numeral 101 indicates a forming range of the die assembly, and reference numeral F indicates a flowing direction of the composite blank material 10 to a draw forming portion in press forming. FIGS. 2A and 2B show a structure of the press forming die assembly 100. FIG. 2A is a side view showing a condition in which the composite blank material 10 is held by a die 111 and a blank holder 121, and FIG. 2B is a sectional side view showing a condition in which a punch 122 is pressed to the die 111 until a bottom dead point.

For example, as shown in FIG. 1, the composite blank material 10 (blank material) is made of a thick sheet portion 11 and a thin sheet portion 12, which are integrally connected at a connecting position 13 by butt-welding and have different sheet thicknesses. The panel 20 may be exemplified by an inner panel for a vehicle, which has a product surface 21 formed into an approximately convex shape by press forming. A ridge line portion 22 in a raised wall is formed around the circumferential end portion of the product surface 21. The corner of the ridge line portion 22 forms a flange portion 23 at which shrink flange forming is performed in press forming. A bead portion 14 is formed around the periphery of the product surface 21. The bead portion 14 has a first bead 15 extending in a direction approximately parallel to the outer peripheral shape of the product surface 21. The bead portion 14 also has a second bead 16 extending from the first bead 15 toward the outside thereof in a direction intersecting the first bead 15.

As shown in FIGS. 2A and 2B, the press forming die assembly 100 includes an upper die 110 and a lower die 120. The upper die 110 has a die 111. The die 111 is formed with a draw forming concave portion 111A at the center portion and is formed with a draw bead convex portion 111B at the circumferential edge portion. In addition, the die 111 is formed with a step portion (not shown in the figure) corresponding to the difference of thicknesses of the thick sheet portion 11 and the thin sheet portion 12 of the composite blank material 10. The step portion is welded with a material that is stronger than the base material of the die assembly and is formed with a sharp edge by finish processing. The step portion receives the difference of the thicknesses of the thick sheet portion 11 and the thin sheet portion 12 and prevents the thick sheet portion 11 from overlapping with the thin sheet portion 12 in press forming.

The lower die 120 includes a blank holder 121, a punch 122, and a NC (numerical control) cushion 123. The blank holder 121 is disposed on the periphery of the punch 122. The blank holder 121 and the peripheral edge portion of the die 111 hold the composite blank material 10 so as to prevent generation of wrinkling on the composite blank material 10. The blank holder 121 is formed with a draw bead concave portion 121B, which engages with the draw bead convex portion 111B of the die 111. The draw bead concave portion 121B and the draw bead convex portion 111B form the bead portion 14 on the composite blank material 10 in press forming so as to generate a tensile strength. Thus, the draw bead concave portion 121B and the draw bead convex portion 111B function as a draw bead 102 for controlling the amount of the composite blank material 10 flowing into the draw forming portion 103.

As described above, the draw bead 102 has a shape corresponding to the bead portion 14. That is, the draw bead 102 includes a first draw bead having a shape corresponding to the first bead 15 of the bead portion 14 and includes a second draw bead having a shape corresponding to the second bead 16 of the bead portion 14. The first draw bead is provided on the periphery of a draw forming portion 103, which will be described hereinafter, in a direction approximately parallel to the outer peripheral shape of the draw forming portion 103. The second draw bead extends from the first draw bead and away from the draw forming portion 103.

An end portion of the punch 122 is formed with a draw forming convex portion 122A, which engages with the draw forming concave portion 111A of the die 111. The draw forming convex portion 122A and the draw forming concave portion 111A perform draw processing on the composite blank material 10 and function as a draw forming portion 103. The draw forming portion 103 has a shape corresponding to the product surface 21 of the panel 20. The composite blank material 10 is held by the peripheral edge portion of the die 111 and the blank holder 121 at holding surfaces, and the NC cushion 123 functions as a device for controlling surface pressure of the holding surfaces.

Figure 3A:
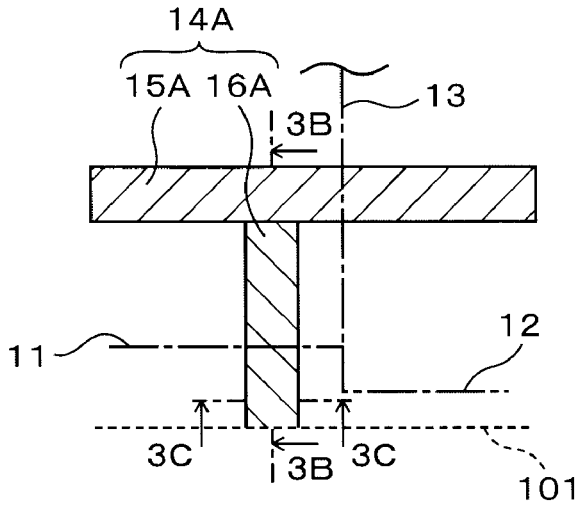
FIGS. 3A to 3C show an example of a structure of a bead portion formed by a draw bead of the press forming die assembly in FIGS. 2A and 2B.
Figure 3B:
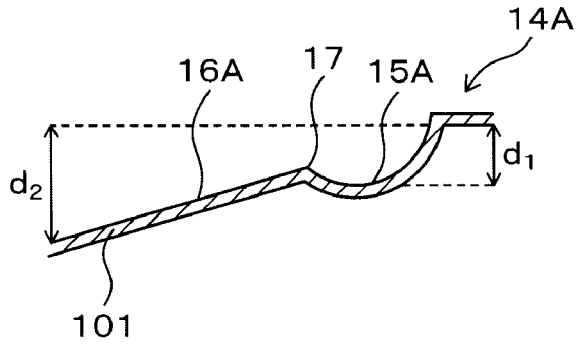
Figure 3C:
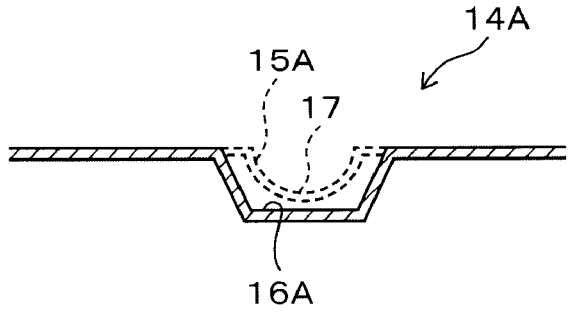

As shown in FIGS. 3A to 6, the bead portion 14 formed by the draw bead 102 may have various shapes. FIGS. 3A to 3C show a shape of a bead portion 14A, FIG. 3A shows a top view, FIG. 3B shows a cross section taken along line 3B-3B in FIG. 3A, and FIG. 3C shows a cross section taken along line 3C-3C in FIG. 3A. The bead portion 14A includes a first bead 15A having an arc shape in cross section and includes a second bead 16A having a trapezoidal shape in cross section. In this case, the second bead 16A extends toward the forming range of the die assembly 101, whereby the second bead 16A does not prevent the blank material flowing into the draw forming portion. The second bead 16A may have an arc shape in cross section instead of a trapezoidal shape in cross section. In a case in which the second bead 16A has a trapezoidal shape, the rotational movement of the thick sheet portion 11 can be further prevented. Specifically, since the ratio of the product surface 21 to the holding surfaces of the blank holder 121 and the die 111 is increased so as to improve the material yield of the composite blank material 10, the rotation of the thick sheet portion 11 must be reliably prevented. Accordingly, the second bead 16A preferably has a trapezoidal shape in cross section so as to effectively provide the above function.

The boundary portion between the first bead 15A and the second bead 16A is formed with a step 17. In this case, when the composite blank material 10 passes through the bead portion 14A, the composite blank material 10 can be formed into a flat shape by a step of the press forming die assembly 100, which corresponds to the step 17 and the first bead 15A, and by the first draw bead. The second bead 16A has a depth $d_2$ at the outer side end portion, and the depth $d_2$ is greater than the depth $d_1$ of the first bead 15A (that is, $d_1<d_2$). In this case, during press forming, the rotation of the thick sheet portion 11 can be prevented by the outer side end portion of the second draw bead (corresponding to the second bead 16A) of the draw bead 102, which has a greater depth than that of the first draw bead (corresponding to the first bead 15A).

Figure 4:
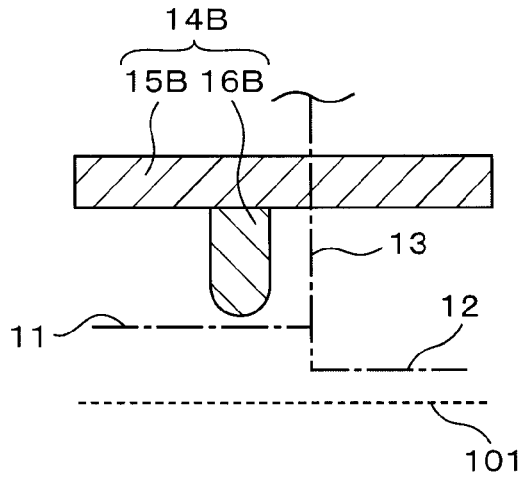
FIG. 4 is a top view showing a structure of additional example of the bead portion in FIGS. 3A to 3C.
Figure 5:
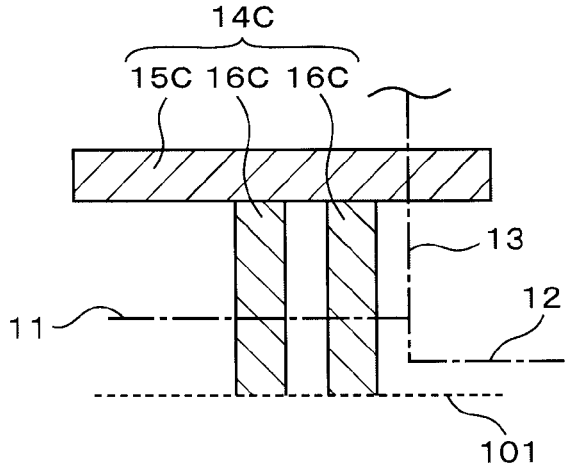
FIG. 5 is a top view showing a structure of another additional example of the bead portion in FIGS. 3A to 3C.
Figure 6:
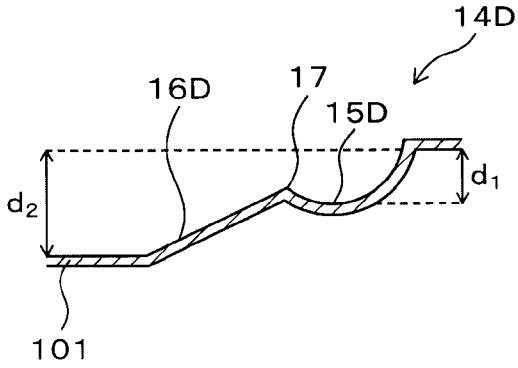
FIG. 6 is a cross section showing a structure of another additional example of the bead portion in FIGS. 3A to 3C.
Figure 7A:
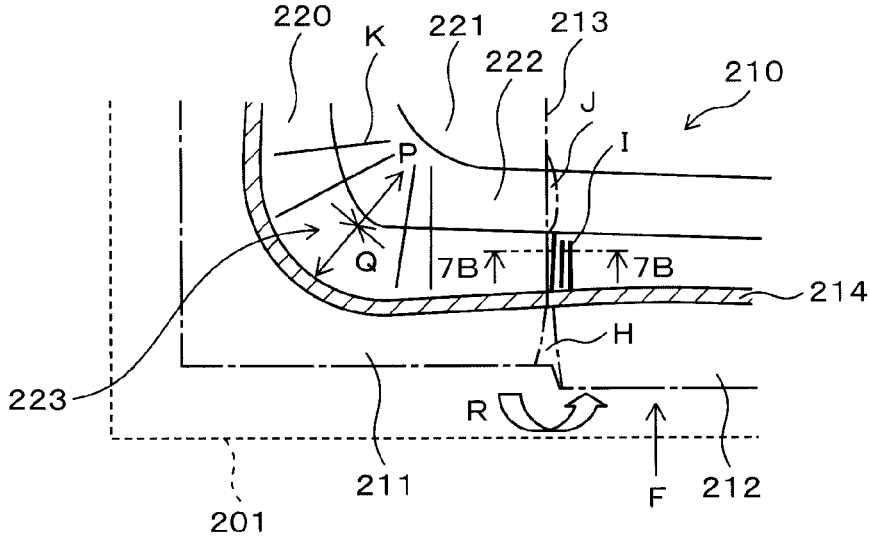
FIGS. 7A and 7B show an example of a composite blank material that includes a panel formed by a conventional press forming die assembly.
Figure 7B:
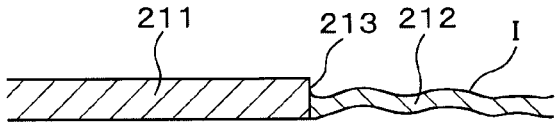

FIGS. 4 and 5 are top views showing a shape of a bead portion 14B and a shape of a bead portion 14C as an additional example of the bead portion 14A, respectively. The bead portion 14B includes a first bead 15B, which is the same as the first bead 15A in FIGS. 3A to 3C. The bead portion 14B also includes a second bead 16B having an outer side end portion which is positioned at the inside of the composite blank material 10 and has a spherical shape. The bead portion 14C includes a first bead 15C, which is the same as the first bead 15A in FIGS. 3A to 3C, and is also provided with two second beads 16C, which are the same as the second bead 16A in FIGS. 3A to 3C. FIG. 6 shows a shape of a bead portion 14D as an additional example of the bead portion 14A, and FIG. 6 shows a cross section viewed at the same cross section as that of FIG. 3B. The bead portion 14D includes a first bead 15D, which is the same as the first bead 15A in FIGS. 3A to 3C, and a second bead 16D having a slope that is terminated between the step 17 and the forming range of the die assembly 101. In this case, the rotation of the thick sheet portion 11 can be reliably prevented.

(2) Operation of Embodiments

Next, an operation of the press forming die assembly 100 will be described with reference to FIGS. 1 to 2B. When the composite blank material 10 is held by the peripheral edge portion of the die 111 and the blank holder 121, the draw forming convex portion 122A of the punch 122 is moved to the draw forming concave portion 111A at the center portion of the die 111. Then, the composite blank material 10 flows into the draw forming portion 103 and is formed so as to have a panel 20 including a product surface 21 with an approximately convex shape.

In such press forming, the bead portion 14 is formed around the product surface 21 by the draw bead convex portion 111B and the draw bead concave portion 121B of the draw bead 102. When the composite blank material 10 is drawn to the draw forming portion 103, the composite blank material 10 is deformed by bending and unbending at the bead portion 14 and is pulled by the bead portion 14 with a predetermined tensile strength. Thus, the amount of the composite blank material 10 flowing into the draw forming portion 103 is controlled.

In this embodiment, the second draw bead (corresponding to the second bead 16) extends from the first draw bead and away from the forming range of the draw forming portion 103 in a direction intersecting the conventional first draw bead (corresponding to the first bead 15). The second draw bead direction corresponds to the direction approximately parallel to the direction F of the composite blank material 10 flowing into the draw forming portion 103 (corresponding to the product surface 21). In general, in shrink flange forming of the flange portion 23 of the thick sheet portion 11, strain (wrinkling) occurs according to the shape of the corner of the draw forming portion 103. Since the second draw bead of the embodiment has the above shape, such strain is not transmitted to the thin sheet portion 12. Therefore, the rotation of the thick sheet portion 11 (movement of the connecting line 13 of the thick sheet portion 11 and the thin sheet portion 12 toward the thin sheet portion 12) can be prevented, whereby the thick sheet portion 11 will not overlap with the thin sheet portion 12.

Accordingly, buckling wrinkling does not occur on the thin sheet portion 12. Therefore, when the composite blank material 10 is used for an inner panel of a vehicle door, an end surface of an outer panel can be connected to the inner panel by a hemming process without deteriorating the quality of the outer panel by buckling wrinkling of the inner panel. Moreover, since strain is not concentrated in the thin sheet portion 12, and a sufficient amount of the material flows into the draw forming portion 103, a crack does not form at the ridge line portion 22 of the product surface 21. Furthermore, when a material having a thick sheet portion 11 and a thin sheet portion 12 having different sheet thicknesses is used as the composite blank material 10, a sharp edge due to the thick sheet portion 11 does not pass through the die assembly. In this case, wear of the die assembly 100 can be avoided, and particles due to the wear are not generated, whereby particles are not trapped at the product surface 21 of the panel 20.

As described above, in the press forming die assembly 100 of the embodiment, the second draw bead prevents strain from being transmitted to the thin sheet portion 12, the strain occurring at the flange portion 23 of the thick sheet portion 11 in shrink flange forming. Therefore, the rotation of the thick sheet portion 11 can be prevented, and the thick sheet portion 11 does not overlap with the thin sheet portion 12. Accordingly, forming failure in the vicinity of the connected portion of the thick sheet portion 11 and the thin sheet portion 12 can be prevented. Moreover, the adjustment operation of the die assembly requires less time in trial forming, and the quality of the panel 20 can be improved in commercial production.

Specifically, when the composite blank material 10 passes through the bead portion 14A, the composite blank material 10 can be formed into a flat shape by the step of the press forming die assembly 100, which corresponds to the step 17 and the first bead 15A, and by the first draw bead. Since the outer side end portion of the second draw bead (corresponding to the second bead 16A) has a depth greater than that of the first draw bead (corresponding to the first bead 15A) of the draw bead 102, the rotation of the thick sheet portion 11 can be prevented.

Embodiments

Hereinafter, embodiments of the present invention will be described in detail with reference to specific embodiments. In first and second embodiments of the present invention and a comparative example, the same composite blank materials having a thick sheet portion and a thin sheet portion were used. The shape of the draw bead was changed with respect to each of the composite blank materials, and analysis of the formation was performed. The thick sheet portion had a thickness of 1.4 mm, and the thin sheet portion had a thickness of 0.7 mm. In the first embodiment, a first draw bead was formed in an arc shape in cross section, and a second draw bead was formed in a trapezoidal shape in cross section. In the second embodiment, a first draw bead was formed in an arc shape in cross section, and a second draw bead was formed in an arc shape in cross section. In the comparative example, a first draw bead was formed in an arc shape in cross section, and a second draw bead was not provided.

The forming analysis of each draw bead of the above first and second embodiments and the comparative example was performed using the following criteria. Generation of cracking (decrease in sheet thickness) at a ridge line portion in a raised wall, and generation of buckling wrinkling (increase in sheet thickness) at the thin sheet portion were evaluated. In addition, deformation of an end surface of a panel (smallest primary strain), and generation of particles (movement amount of a connecting line of a thick sheet portion and a thin sheet portion) were evaluated. The evaluation results are shown in Table 1. Each evaluation result of the first and the second embodiments and the comparative example was compared with the results of an actual machine test. The actual machine test was performed by using a composite blank material having the same condition as that of the second embodiment. In this case, a result of the forming analysis that was better than that of the actual machine test is indicated by ○, and other results are indicated by x. It should be noted that there was a correlation between the forming analysis of the second embodiment and the results of the actual machine test performed under the same condition as that of the second embodiment.

TABLE 1

| | Evaluation of crack at raised wall ridge line portion | Evaluation of buckling wrinkling | Evaluation of deformation of end surface of panel | Evaluation of generation of particles | Comprehensive Evaluation |
|---|---|---|---|---|---|
| First Embodiment | ○ | ○ | ○ | ○ | ○ |
| Second Embodiment | ○ | ○ | ○ | ○ | ○ |
| Comparative Example | X | X | X | X | X |

As shown in Table 1, the first and the second embodiments exhibited good results in the evaluation of the generation of cracking at a ridge line portion in a raised wall and the evaluation of the generation of buckling wrinkling at the thin sheet portion, compared to the comparative example. The first and the second embodiments also exhibited good results in the evaluation of the deformation of the end surface of the panel and the evaluation of the generation of particles, compared to the comparative example. Therefore, the draw bead of the present invention having a second draw bead is superior to the conventional draw bead having only a first draw bead. In all of the evaluations, the results of the first embodiment were better than those of the second embodiment (not shown in Table 1). Therefore, it is preferable that the second draw bead of the present invention have a trapezoidal shape in cross section.

What is claimed is:

1. A press forming die assembly for press forming a blank material, said blank material including an outer peripheral edge, the press forming die assembly comprising:

a draw forming portion into which the blank material flows in press forming; and a draw bead for controlling an amount of the blank material flowing into the draw forming portion, the draw bead including a first draw bead and a second draw bead, the first draw bead being provided at a periphery of the draw forming portion and extending around an outer periphery of the draw forming portion, and the second draw bead extending from the first draw bead away from the draw forming portion in a direction toward the outer peripheral edge, the blank material including a thick/rigid area and a thin/flexible area, the thick/rigid area including at least one of a thick sheet portion and a high rigidity portion, the thin/flexible area including at least one of a thin sheet portion and a low rigidity sheet portion, the thick sheet portion having a thickness that is greater than a thickness of the thin sheet portion and the high rigidity portion having a rigidity that is greater than a rigidity of the low rigidity sheet portion, wherein the press forming die assembly is adapted to provide the first draw bead to the thick/rigid and thin/flexible areas and the second draw bead to only the thick/rigid area.

2. The press forming die assembly according to claim 1, wherein the first draw bead and the second draw bead have a boundary portion provided with a step.

3. The press forming die assembly according to claim 1, wherein the second draw bead has an end portion at the outside of the draw forming portion, and the end portion has a depth which is greater than the depth of the first draw bead.

4. The press forming die assembly according to claim 1, the second draw bead including a first end and a second end, the first end intersecting the first draw bead, the second end being opposite the first end and adjacent the outer peripheral edge.

5. The press forming die assembly according to claim 4, wherein a distance between the first end and the second end of the second draw bead is equal to a distance that the first draw bead is spaced from the outer peripheral edge.

* * * * *